US005927538A

United States Patent [19]

Collins

[11] Patent Number: 5,927,538

[45] Date of Patent: Jul. 27, 1999

[54] CEREAL BOWL

[76] Inventor: Willie P. Collins, 3075 Chaparral Pl., Lithonia, Ga. 30058

[21] Appl. No.: 09/046,006

[22] Filed: Mar. 23, 1998

[51] Int. Cl.[6] ..... B65D 8/12

[52] U.S. Cl. ..... 220/574.1; 220/574; 220/575; 220/501; 220/505

[58] Field of Search ..... 220/574.1, 574, 220/575, 501, 505

[56] References Cited

U.S. PATENT DOCUMENTS

| | | | |
|---|---|---|---|
| D. 283,096 | 3/1986 | Uhrik | D7/27 |
| D. 305,846 | 2/1990 | Griffith | D7/555 |
| D. 386,358 | 11/1997 | Pfeilsticker | D7/555 |
| 4,069,940 | 1/1978 | Naimoli | 220/20 |
| 4,986,434 | 1/1991 | Prestyly, Jr. | 220/574 |
| 5,042,712 | 8/1991 | DeRoseau | 220/574.1 |
| 5,341,953 | 8/1994 | Forester | 220/575 |
| 5,464,150 | 11/1995 | Porres Sanchez et al. | 229/120.38 |
| 5,542,565 | 8/1996 | Hidalgo-Lopez | 220/574.1 |
| 5,626,256 | 5/1997 | Onneweer | 220/574 |

*Primary Examiner*—Joseph M. Moy
*Attorney, Agent, or Firm*—John L. James

[57] ABSTRACT

A cereal bowl is partitioned providing separate compartments for cereal and milk or other liquid used with dry cereal. The liquid compartment is further divided into a liquid reservoir and a mixing compartment. The dry cereal and liquid are united one spoon full at a time in the mixing compartment. The bottom of the mixing compartment is lower than the bottom of the liquid reservoir so that all liquid may be used. The mixing compartment is slightly larger than a cereal spoon so that dry cereal does not escape from the spoon when introduced into the liquid in the mixing compartment.

8 Claims, 1 Drawing Sheet

CEREAL BOWL

FIELD OF THE INVENTION

The present invention relates generally to bowls, and more particularly, to a cereal bowl with a partition to separate dry cereal and the liquid used to moisten the cereal.

BACKGROUND OF THE INVENTION

Dry cereal is moistened with a liquid, typically milk, before it is eaten. The dry cereal and milk are usually mixed together in a cereal bowl where the mixture sits until eaten. While the first few spoons full are usually crispy, the remaining spoons full are soggy. A partitioned cereal bowl has separate compartments for the cereal and milk allowing the cereal and milk to remain separated until immediately before it is eaten so that it remains crispy. A problem with conventional partitioned cereal bowls is that some of the cereal disperses into the milk compartment when attempting to moisten the cereal by dipping a spoon full into the milk. Naturally, the dispersed cereal becomes soggy and therefore undesirable. Another problem with conventional partitioned cereal bowls is that it is difficult to use all of the milk. The depth of the milk must be sufficient to enter the spoon at all times to be available for moistening the cereal which causes milk to remain after the cereal is consumed. Accordingly, it will be appreciated that it would be highly desirable to have a partitioned cereal bowl that prevents the cereal from dispersing in the milk and that allows all the milk to be used.

SUMMARY OF THE INVENTION

The present invention is directed to overcoming one or more of the problems set forth above. Briefly summarized, according to one aspect of the present invention, a partitioned cereal bowl comprises a bottom having a first bottom portion with a first surface and a second bottom portion with a second surface, the second surface being at a higher elevation than the first bottom surface; a continuous sidewall extending upward from the bottom; a first partition extending upward from the first surface of the first bottom portion and extending from one portion of the continuous sidewall to another portion of the continuous sidewall dividing the cereal bowl into a cereal compartment and a liquid compartment; a second partition in the liquid compartment extending upward from the bottom portion and having an arcuate configuration forming a small compartment within the liquid compartment for receiving a cereal spoon; and connecting means for connecting the liquid compartment and the small compartment so that liquid flows from the liquid compartment into the small compartment.

The partitioned cereal bowl prevents the cereal from dispersing in the milk and that allows all the milk to be used. Dry cereal and liquid are united one spoon full at a time in the mixing compartment. The bottom of the mixing compartment is lower than the bottom of the liquid reservoir so that all liquid may be used. The mixing compartment is slightly larger than a cereal spoon so that dry cereal does not escape from the spoon when introduced into the liquid in the mixing compartment.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
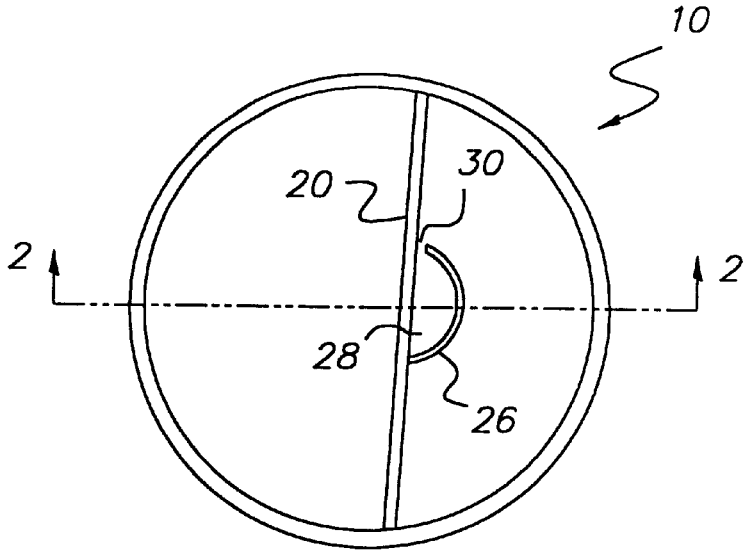
FIG. 1 is a top view of a preferred embodiment of a partitioned cereal bowl according to the present invention.
Figure 2:
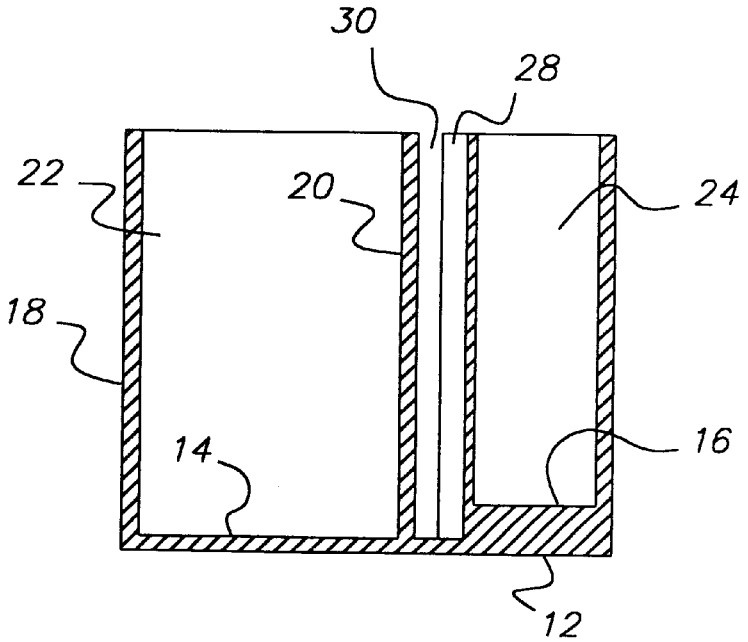
FIG. 2 is a sectional view taken along line 2—2 of FIG. 1.

Referring to FIGS. 1–2, a partitioned cereal bowl 10 has a bottom 12 divided into a first bottom portion with a first surface 14 and a second bottom portion with a second surface 16. The second bottom surface 16 is at a higher elevation than the first bottom surface 14. A continuous sidewall 18 extends upward from the bottom 12. Sidewall 18 may be perfectly vertical or may slant outward overhanging the bottom 12, and the corners between the bottom and sidewall may be straight as illustrated or curved as is known in the art.

A first partition 20 extends upward from the first surface 14 of the first bottom portion and extends from one portion of the continuous sidewall 18 to another portion of the continuous sidewall dividing the cereal bowl into a cereal compartment 22 and a liquid compartment 24.

A second partition 26 in the liquid compartment 24 extends upward from the bottom. The second partition 26 has an arcuate configuration to facilitate receiving a cereal spoon without excess space for cereal to spill. It preferably extends from one portion of the first partition 20 toward the sidewall 18 and curves back toward the first partition 20 thereby forming a small compartment 28 within the liquid compartment 24. Alternatively, the second partition could extend from sidewall 18, curve toward first partition 20 and curve back toward sidewall 18 to form the small compartment 28. Also, the second partition could be positioned in the liquid compartment with attaching to either the sidewall or first partition, or could attach to both the sidewall and first partition.

A connecting means, preferably a slot or opening 30 existing between the first and second partitions, is provided for connecting the liquid compartment 24 and the small compartment 28 so that liquid flows from the liquid compartment into the small compartment. Because the bottom surface 16 of the liquid compartment is at a higher elevation than the bottom surface 14 of the small compartment 28, all the liquid will flow into the small compartment. Alternatively, the slot or opening 30 could be a slot or opening in the second partition, or between the second partition and the sidewall.

Operation of the present invention is believed to be apparent from the foregoing description and drawings, but a few words will be added for emphasis. Dry cereal is placed in the cereal compartment and milk or other liquid is poured into the liquid compartment. Some of the liquid flows through the slot into the small compartment. A spoon full of cereal is dipped in the small compartment to moisten the cereal immediately prior to eating so that the cereal is always crisp. The small dimensions of the small compartment allow the spoon to enter, but do not provide room for cereal to float around and leave the spoon. There is therefore virtually no cereal in the liquid to become soggy and wasted. As the liquid is used, the remaining liquid gravitates from the liquid compartment to the small compartment so that it can all be used.

It can now be appreciated that the partitioned cereal bowl prevents the cereal from dispersing in the milk and allows all the milk to be used. The cereal is introduced into the liquid as it is eaten, the cereal therefore remains crispy. Because the bottom of the small compartment is at a lower elevation than the bottom of the liquid compartment, the liquid eventually all gravitates to the small compartment to be used on spoon full at a time.

While the invention has been described with particular reference to the preferred embodiments, it will be understood by those skilled in the art that various changes may be made and equivalents may be substituted for elements of the preferred embodiments without departing from invention. For example, the tops of the partitions may be at the same elevation as the sidewall or may be lower for aesthetic appeal. It is accordingly intended that the claims shall cover all such modifications and applications as do not depart from the true spirit and scope of the invention.

What is claimed is:

1. A partitioned cereal bowl, comprising:

a bottom having a first bottom portion with a first surface and a second bottom portion with a second surface, said second surface being at a higher elevation than said first bottom surface;

a continuous sidewall extending upward from said bottom;

a first partition extending upward from said first surface of said first bottom portion and extending from one portion of said continuous sidewall to another portion of said continuous sidewall dividing said cereal bowl into a cereal compartment and a liquid compartment;

a second partition in said liquid compartment extending upward from said bottom portion and having an arcuate configuration forming a small compartment within said liquid compartment for receiving a cereal spoon; and connecting means for connecting said liquid compartment and said small compartment so that liquid flows from said liquid compartment into said small compartment.

2. A partitioned cereal bowl, as set forth in claim 1, wherein said connecting means is an opening in said second partition.

3. A partitioned cereal bowl, as set forth in claim 1, wherein said connecting means is an opening existing between said first and second partitions.

4. A partitioned cereal bowl, as set forth in claim 1, wherein said connecting means is an opening existing between said second partition and said sidewall.

5. A partitioned cereal bowl, comprising:

a bottom having a first bottom portion with a first surface and a second bottom portion with a second surface, said second surface being at a higher elevation than said first bottom surface;

a continuous sidewall extending upward from said bottom;

a first partition extending upward from said first surface of said first bottom portion and extending from one portion of said continuous sidewall to another portion of said continuous sidewall dividing said cereal bowl into a cereal compartment and a liquid compartment;

a second partition in said liquid compartment extending upward from said bottom portion, said second partition having an arcuate configuration extending from one portion of said first partition toward said sidewall and curving back toward said first partition thereby forming a small compartment within said liquid compartment; and connecting means for connecting said liquid compartment and said small compartment so that liquid flows from said liquid compartment into said small compartment.

6. A partitioned cereal bowl, as set forth in claim 5, wherein said connecting means is an opening in said second partition.

7. A partitioned cereal bowl, as set forth in claim 5, wherein said connecting means is an opening existing between said first and second partitions.

8. A partitioned cereal bowl, as set forth in claim 5, wherein said connecting means is an opening existing between said second partition and said sidewall.

* * * * *